US006690149B2

(12) United States Patent
Monomoushi et al.

(10) Patent No.: US 6,690,149 B2
(45) Date of Patent: Feb. 10, 2004

(54) POWER SUPPLY AND DISPLAY APPARATUS INCLUDING THEREOF

(75) Inventors: Masahiko Monomoushi, Kashihara (JP); Masafumi Katsutani, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/241,531

(22) Filed: Sep. 12, 2002

(65) Prior Publication Data

US 2003/0052659 A1 Mar. 20, 2003

(30) Foreign Application Priority Data

Sep. 12, 2001 (JP) ..... 2001-277065

(51) Int. Cl.[7] ..... G05F 1/12; B09G 5/00
(52) U.S. Cl. ..... 323/297; 345/210
(58) Field of Search ..... 323/282, 293, 323/297; 345/210, 211

(56) References Cited

U.S. PATENT DOCUMENTS 6,304,255 B1 * 10/2001 Suzuki et al. ..... 345/211
6,373,225 B1 * 4/2002 Haraguchi et al. ..... 320/122
6,501,467 B2 * 12/2002 Miyazaki ..... 345/210
6,538,631 B1 * 3/2003 Kwon ..... 345/96
6,549,196 B1 * 4/2003 Taguchi et al. ..... 345/210
6,600,466 B1 * 7/2003 Rosenquist ..... 345/87

FOREIGN PATENT DOCUMENTS

JP 55-146487 11/1980

* cited by examiner

*Primary Examiner*—Adolf D. Berhane
(74) *Attorney, Agent, or Firm*—Birch, Stewart, Kolasch & Birch, LLP

(57) ABSTRACT

A power supply in accordance with the present invention includes: a resistance voltage-dividing circuit for generating an intermediate voltage, to which a targeted voltage value is allocated, from a supplied voltage; an N-type transistor which causes a current flow into from an outside when the intermediate voltage is higher than the targeted voltage value; a P-type transistor which outputs a current to the outside when the intermediate voltage is lower than the targeted voltage value; differential amplifier circuits having a voltage-follower arrangement, in each of the circuits the fluctuation acceptance range of the intermediate voltage with respect to the targeted voltage value being arranged so as to be equivalent to the difference between the operation-starting voltage of the N-type transistor and the operation-starting voltage of the P-type transistor; and resistances which activate either the P-type transistor or the N-type transistor so as to regulate the intermediate voltage by making the intermediate voltage approximately equal to the targeted voltage value. Thus, it is possible to provide driving electric powers with low power consumption and a stable output voltage, and the voltage fluctuation of the output voltage is promptly adjusted.

28 Claims, 9 Drawing Sheets

POWER SUPPLY AND DISPLAY APPARATUS INCLUDING THEREOF

FIELD OF THE INVENTION

The present invention relates to a power supply which is included in a display apparatus such as a liquid crystal display apparatus and used for supplying electric power for driving display pixels, and a display apparatus equipped with the power supply.

BACKGROUND OF THE INVENTION

Referring to FIG. 4 which is an explanatory drawing of the present invention, the following description will discuss a liquid crystal display apparatus which is an example of a display apparatus.

On the side of segment electrodes of a liquid crystal panel 1, a segment driver 3 for driving segment electrodes X1–Xm is provided, while on the side of common electrodes, a common driver 2 for driving common electrodes Y1–Yn is provided. To the segment driver 3, a power supply circuit (power supply) 5 supplies driving electric powers V0, V2, V3, and V5. In contrast, to the common driver 2, the power supply circuit 5 supplies driving electric powers V0, V1, V4, and V5.

Various circuit arrangements have conventionally been proposed as the power supply circuit 5 which supplies the driving electric powers V0–V5. By the way, in the power supply circuit 5, a generation circuit for supplying voltages to the segment driver 3 is substantially identical with a generation circuit for supplying voltages to the common driver 2. Therefore the generation circuit for supplying a voltage for the segment driver 3 is taken as an example here, for the sake of simplicity.

For instance, a power supply circuit 35, which is illustrated in FIG. 7, outputs driving electric powers V0, V2, V3, and V5 by voltage-dividing using resistances. In this power supply circuit 35, three bleeder resistances R101, R102, and R103 divide the voltage between an electric power (VEE) and a ground (GND) so as to generate two intermediate voltages, and these two are outputted as driving electric powers V2 and V3.

In contrast, as illustrated in FIG. 8, a power supply circuit 36 is arranged such that lines, which are used for obtaining the driving electric powers V2 and V3 by voltage-dividing using resistances in the power supply circuit 35 in FIG. 7, are connected with operational amplifiers OP1 and OP2, for dropping the impedance of an output stage. This power supply circuit 36 makes it possible to regulate the driving electric powers V2 and V3 generated by way of voltage-dividing, by carrying out impedance conversion in the operational amplifiers OP1 and OP2.

In the power supply circuits 35 and 36, the values of the bleeder resistances R101 through R103 are preferably small, to reduce the voltage fluctuation and to regulate the voltages of the driving electric powers V0, V2, V3, and V5, even if pixels of the liquid crystal panel 1 which is a capacity load are charged or discharged. However, when the values of the bleeder resistances R101 through R103 are small, the power consumption in the power supply circuits 35 and 36 is high.

Moreover, when the operational amplifiers OP1 and OP2 in the power supply circuit 36 obtain enough electric power for liquid crystal displaying, constant currents in the operational amplifiers are high to a certain extent, and this obstructs the reduction of the power consumption. That is, in each of the operational amplifiers OP1 and OP2, constant current sources are mainly provided in (i) a differential pair section in the input stage and (ii) the output stage, and especially the constant current source in the output stage, which is provided as a load circuit, cannot follow the voltage fluctuation if the value of the constant current is low.

To solve the above-identified problem, Japanese Laid-Open Patent Application No. 55-146487/1980 (Tokukaisho 55-146487; published on Nov. 14, 1980) discloses a power supply circuit which is basically arranged similar to the aforementioned power supply circuit 35 but the driving electric powers V0, V2, V3, and V5 can be regulated despite the values of the bleeder resistances are risen in order to reduce the power consumption.

As FIG. 9 illustrates, a high voltage side is grounded in a power supply circuit 37 disclosed by the publication above, and thus driving electric powers V0, −V2, −V3, and −V5 are acquired. The power supply circuit 37 is arranged so that output voltages which are outputted as the driving electric powers −V2 and −V3 are generated by bleeder resistances (hereinafter, will be simply referred to as resistances) having high resistance values, and fluctuations surpassing acceptable voltage values of the respective driving electric powers −V2 and −V3 are detected so that the fluctuations are restrained by MOS transistors MQ11 through MQ14. Incidentally, DN is an electric power node and SN is a grounding node in FIG. 9.

In the power supply circuit 37, series resistances R101 through R103 are resistance voltage-dividing circuits, in which a voltage −V5 of an electric power E is divided in three so that intermediate voltages which are to be the driving electric powers −V2 and −V3 are obtained. Then with reference to the divided voltages −V2 and −V3 which are intermediate voltages obtained by voltage-dividing using resistances, reference voltages −VH2, −VL2, −VH3, and −VL3 for setting respective acceptable ranges ΔV of the voltage fluctuations are generated by a voltage dividing circuit constituted by series resistances R104–R108.

Moreover, a voltage comparator circuit (hereinafter, will be simply referred to as comparator) CMP1, whose inverting input terminal receives the reference voltage −VH2 while non-inverting input terminal receives the divided voltage −V2, and an nMOS transistor MQ12, which is connected between a divided voltage output point and the voltage −V5 of the electric power E and controlled by the output of the comparator CMP1, are provided, so that when the output voltage of a line through which the divided voltage −V2 runs varies so as to surpass the reference voltage −VH2 in the positive direction (towards the ground voltage), the nMOS transistor MQ12 is turned on in order to restrain the output fluctuation surpassing the acceptable range ΔV in the positive direction.

Meanwhile, (i) a comparator CMP2 whose non-inverting input terminal receives the reference voltage −VL2 while inverting input terminal receives the divided voltage −V2 and (ii) a pMOS transistor MQ11, which is connected between the divided voltage output point and the ground voltage V0 and controlled by the output of the comparator CMP2, are provided, so that when the output voltage of a line through which the divided voltage −V2 runs varies so as to surpass the reference voltage −VL2 in the negative direction (towards the voltage −V5), the pMOS transistor MQ11 is turned on in order to restrain the output fluctuation surpassing the acceptable range ΔV in the negative direction.

Likewise, the fluctuation of the output voltage −V3, which surpasses the acceptable range ΔV, is restrained. That is to say, a comparator CMP3, whose inverting input terminal receives the reference voltage −VH3 while non-inverting input terminal receives the divided voltage −V3, and an nMOS transistor MQ14, which is connected between the divided voltage output point and the voltage −V5 of the electric power E and controlled by the output of the comparator CMP3, are provided, so that when the output voltage of a line through which the divided voltage −V3 runs varies so as to surpass the reference voltage −VH3 in the positive direction (towards the ground voltage), the nMOS transistor MQ14 is turned on in order to restrain the output fluctuation surpassing the acceptable range ΔV in the positive direction.

In the meantime, (i) a comparator CMP4, whose inverting input terminal receives the reference voltage −VL3 while non-inverting input terminal receives the divided voltage −V3, and (ii) a pMOS transistor MQ13, connected between the divided voltage output point and the ground voltage V0 and controlled by the output of the comparator CMP4, are provided, so that when the output voltage of a line through which the divided voltage −V3 runs varies so as to surpass the reference voltage −VL3 in the negative direction (towards the voltage −V5), the pMOS transistor MQ13 is turned on in order to restrain the output fluctuation surpassing the acceptable range ΔV in the negative direction.

On this account, the voltage fluctuations of the output voltages corresponding to the respective divided voltages −V2 and −V3 which are to be the driving electric powers −V2 and −V3 are restrained so as to fall within the acceptable ranges ΔV which are determined by the voltage drop caused by the resistances R105 and R107.

This power supply circuit 37 is arranged so that the power consumption can be restrained by specifying the values of the resistances R101–R103 and R-104–R108 high, and since the MOS transistors MQ11–MQ14, which are activated only when the voltage fluctuation surpasses the acceptable ranges ΔV and have high current driving ability (i.e. capable of feeding a large amount of current), are provided in the output stages, the driving abilities of the output stages of the comparators CMP1–CMP4 are not necessarily high. Thus it is possible to reduce the currents supplied from the constant current sources provided in the comparators CMP1–CMP4 so that the power consumption of the power supply circuit 37 can be significantly reduced.

Furthermore, each of the MOS transistors MQ11–MQ14 has an offset voltage thanks to the acceptable range ΔV so that only one of the transistors MQ11–MQ14 is turned on at a time, and thus a through current (a current which runs due to the shorting of two power supply lines paring up with each other) is not generated.

As a result, the power supply circuit 37 arranged as above can be a power supply circuit of a display apparatus, which consumes a small amount of electricity and produces consistent output voltages.

Generally speaking, a load-carrying capacity of each pixel and a parasitic capacitance of each electrode line are large in a large-size liquid crystal panel, and hence the power supply circuit has to have high driving ability, in order to precipitously carry out charging or discharging the members above. Also, to obtain a high-quality image, the power supply circuit is required to have a driving electric power with small voltage fluctuation, to promptly respond to the fluctuation, and to consume a small amount of electricity.

So, in the power supply circuit 37 (FIG. 9), the divided voltages −V2 and −V3, which are to be the driving electric powers −V2 and −V3, are speedily brought back to the respective acceptable ranges ΔV thanks to the MOS transistors MQ11–MQ14 which have high driving ability. However, once the divided voltages −V2 and −V3 are brought back to the respective acceptable ranges ΔV, the resistances R101–R103 make these voltages converge to respective targeted voltage values. By the way, the targeted values are voltage values outputted between the resistances connected in series. Thus, in the circuit arrangement of the power supply circuit 37, the convergent to the targeted voltage values takes much time when the resistances R101–R103 have high resistance values.

As a result, in the power supply circuit 37, when the values of resistances R101–R103 and the resistances R104–R108, each group of the resistances constituting a resistance voltage-dividing circuit, are arranged so as to be high in order to further reduce the power consumption, it takes long time to regulate the output voltages corresponding to the divided voltages −V2 and −V3 at the respective targeted values (i.e. it takes long time until the voltage values converge to the respective targeted values within the acceptable ranges ΔV). On this account, the power supply circuit 37 will not be able to comply with further enlargement of the screen and improvement of image quality of the liquid crystal display, due to the occurrence of the degradation of the image quality.

Moreover, the power supply circuit 37 includes two groups of resistances, namely the resistances R101–R103 and the resistances R104–R108, as the resistance voltage-dividing circuits, so that the power consumption in this arrangement is inevitably higher than the power consumption of the arrangement in which only one group of resistances are adopted as the resistance voltage-dividing circuit.

Furthermore, since the power supply circuit 37 determines the voltage-dividing ratio by the resistances R101–R103 provided in the output stage, it is necessary to keep the voltage-dividing ratio when the resistance values of the resistances R101–R103 are changed. Thus, the size of the respective circuits is increased when a programmable modification of the resistance values using an internal resistor is carried out.

SUMMARY OF THE INVENTION

The present invention was done to solve the above-identified problems, so as to aim at providing a power supply: being able to keep up with further increase of the display screen without the degradation of the quality of display images, as well as further improvement of the quality of display images; being capable of steadily supplying driving electric powers by an output voltage with a small fluctuation and rapidly restoring the regulated state when the output voltage fluctuates, despite consuming a small amount of electricity; and being capable of adopting programmable modification of the resistance values using an internal resistor without the increase of the size of the power supply. Furthermore, the present invention aims at providing a display apparatus including the above-mentioned power supply.

To solve the problems above, the power supply in accordance with the present invention includes: a resistance voltage-dividing circuit for generating an intermediate voltage, whose targeted voltage value is specified, from a supplied voltage; at least one voltage follower circuit including (i) an N-type transistor for causing a current flow into the at least one voltage follower circuit from an outside when the intermediate voltage is higher than the targeted voltage value and (ii) a P-type transistor for outputting a current to the outside when the intermediate voltage is lower than the targeted voltage value, a fluctuation acceptance range of the intermediate voltage with respect to the targeted voltage value being specified so as to be equivalent to a difference between an operation-starting voltage of the N-type transistor and an operation-starting voltage of the P-type transistor; and a resistance for regulating the intermediate voltage at a value approximately equal to the targeted voltage value, by activating either one of the P-type transistor or the N-type transistor so as to vary the intermediate voltage.

According to this arrangement, when the intermediate voltage significantly fluctuates so as to surpass the target voltage value, either one of the P-type transistor and the N-type transistor of the voltage follower circuit, the transistor being capable of bringing the intermediate voltage back to the targeted voltage value, operates so that the deviated intermediate voltage is rapidly brought back to the targeted voltage value. Here, in the voltage follower circuit, a fluctuation acceptance range of the intermediate voltage with respect to the targeted voltage value is specified so as to be equivalent to a difference between an operation-starting voltage of the N-type transistor and an operation-starting voltage of the P-type transistor.

On this account, the intermediate voltage is kept within the fluctuation acceptable range without being significantly deviated from the targeted voltage value. That is to say, the intermediate voltage is regulated so as to be, for instance, within the fluctuation acceptable range having its center at the targeted voltage value (between the maximum and minimum voltage values). However, in the arrangement above, the intermediate voltage is hardly kept at a fixed value within the fluctuation acceptable range so as to be easily fluctuate. By the way, the reasons, etc. of this will be specifically described in Description of the Embodiments.

Thus, the power supply is provided with a resistance, for eliminating the above-identified fluctuation of the intermediate voltage. This resistance is arranged such that the P-type transistor or the N-type transistor is activated so that a current is supplied to the outside or pulled in from the outside, and hence the intermediate voltage outputted from the output stage is varied so as to be approximately equal to the targeted voltage value. On this account, Without the fluctuation within the fluctuation acceptable range around the targeted voltage value, the intermediate voltage is forcibly varied so as to be approximately equal to the targeted voltage value, and consequently the intermediate voltage is regulated and stabilized.

In this manner, the power supply is arranged so that, when the intermediate voltage fluctuates so as to surpass the fluctuation acceptable range, either the P-type transistor or the N-type transistor operates so that the intermediate voltage is rapidly brought back to the fluctuation acceptable range. Moreover, when the intermediate voltage fluctuates within the fluctuation acceptable range, thanks to the operation of either the P-type transistor or the N-type transistor, the intermediate voltage value is forcibly varied so as to be approximately equal to the targeted voltage value, and consequently regulated. On this account, the intermediate voltage is regulated at a voltage value approximately equal to the targeted voltage value, without the fluctuation within the fluctuation acceptable range.

Therefore, in spite of the low-power-consumption, the power supply can steadily supply driving electric powers by an output voltage with a small fluctuation and rapidly restoring the regulated state when the output voltage fluctuates, and hence the power supply can keep up with further increase of the display screen without the degradation of the quality of display images as well as further improvement of the quality of display images.

Furthermore, according to the arrangement above, since the fluctuation of the output voltage can be restrained so as to be regulated without providing a bleeder resistance in the output stage, it is possible to realize further reduction of the power consumption. Moreover, since the voltage-dividing ratio is not determined by the bleeder resistance in the output stage, the size of the circuit does not increase even if the programmable modification of the resistance values using an internal resistor is carried out.

Moreover, to solve the problems above, the display apparatus in accordance with the present invention, including a display panel, a drive unit for driving the display panel, and a power supply for supplying driving electric power, which is for driving the display panel, to the drive unit, further includes the aforementioned power supply in accordance with the present invention.

As described above, the power supply in accordance with the present invention is arranged so as to: be able to keep up with further increase of the display screen without the degradation of the quality of display images, as well as further improvement of the quality of display images; be capable of steadily supplying driving electric powers by an output voltage with a small fluctuation and rapidly restoring the regulated state when the output voltage fluctuates, despite consuming a small amount of electricity; and be capable of adopting programmable modification of the resistance values using an internal resistor without the increase of the size of the power supply.

Thus, thanks to the arrangement as above, using this power supply enables to realize a display apparatus with a large screen, good display quality, and low-power-consumption.

For a fuller understanding of the nature and advantages of the invention, reference should be made to the ensuing detailed description taken in conjunction with the accompanying drawings.

DESCRIPTION OF THE EMBODIMENTS

The following description will discuss an embodiment in accordance with the present invention in reference to FIGS. 1 through 6.

First, referring to FIG. 4, a common arrangement of a liquid crystal display apparatus (display apparatus) in accordance with the present embodiment, on which a power supply circuit (power supply) 5 is mounted, will be described as below. Incidentally, among liquid crystal driving methods, such as a driving method using a TFT and a driving method using STN liquid crystal, which are for the liquid crystal display apparatus, a matrix driving method is adopted in this description.

Figure 4:
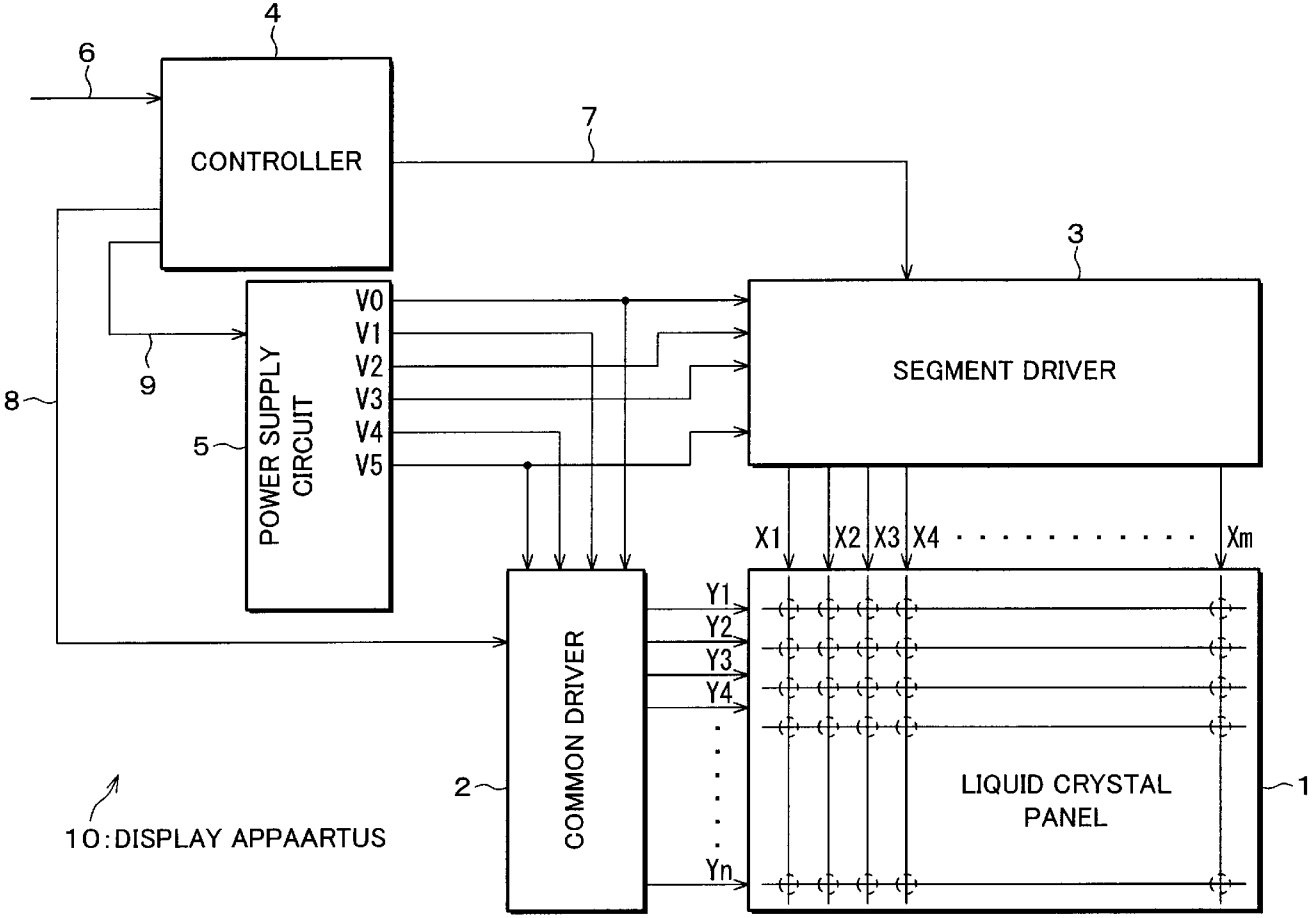
FIG. 4 is a block diagram, schematically describing an arrangement of a liquid crystal display apparatus on which the power supply circuit shown in FIG. 1 is mounted.

As illustrated in FIG. 4, the liquid crystal display apparatus as above mainly includes: a liquid crystal panel (display panel) 1; a drive circuit on the common side (hereinafter, will be simply referred to as common driver) (drive unit) 2; a drive circuit on the segment side (hereinafter, will be simply referred to as segment driver) (drive unit) 3; a controller 4; and a power supply circuit (power supply) 5.

The liquid crystal panel 1 includes a pair of glass substrates facing with each other so as to sandwich a liquid crystal layer. One glass substrate is provided with segment electrodes X1 through Xm on its side of facing the liquid crystal layer. Meanwhile, the other glass substrate is provided with common electrodes Y1 through Yn orthogonal to the segment electrodes, on its side of facing the liquid crystal layer.

The segment driver 3 is provided for driving the segment electrodes X1–Xm of the liquid crystal panel 1, so as to be provided on the side of the segment electrodes. The common driver 2 is provided for driving the common electrodes Y1–Yn of the liquid crystal panel 1, so as to be provided on the side of the common electrodes.

The power supply circuit 5 generates voltages applied to the electrodes of the liquid crystal panel 1, and hence has driving electric powers V0 through V5. Among the driving electric powers V0–V5, the driving electric powers V0, V2, V3, and V5 are controlled via the segment driver 3 so as to be applied to the segment electrodes X1–Xm of the liquid crystal panel 1. In contrast, the driving electric powers V0, V1, V4, and V5 are controlled via the common driver 2 so as to be applied to the common electrodes Y1–Yn of the liquid crystal panel 1. Applying the voltages above to the segment electrodes X1–Xm and the common electrodes Y1–Yn enables the liquid crystal panel 1 to carry out gray scale display by a pulse-width modulation method.

Moreover, the controller 4 controls the segment driver 3, the common driver 2, and the power supply circuit 5. More specifically, first, the controller 4 receives a control signal 6 which is necessary for displaying digital display data, a vertical synchronizing signal, a horizontal synchronizing signal, etc. from the outside. Then after adjusting the timing of the received signals, the controller 4 supplies (i) the digital display data, a transfer clock, a data latch signal, the horizontal synchronizing signal, an AC-converting signal, etc. to the segment driver 3 as a control signal 7, and (ii) the horizontal synchronizing signal, the vertical synchronizing signal, the AC-converting signal, etc. to the common driver 2 as a control signal 8. Moreover, the controller 4 supplies a control signal 9 such as a cut signal, which is for cutting the electrical power when unnecessary so as to reduce the power consumption, to the power supply circuit 5.

Figure 5:
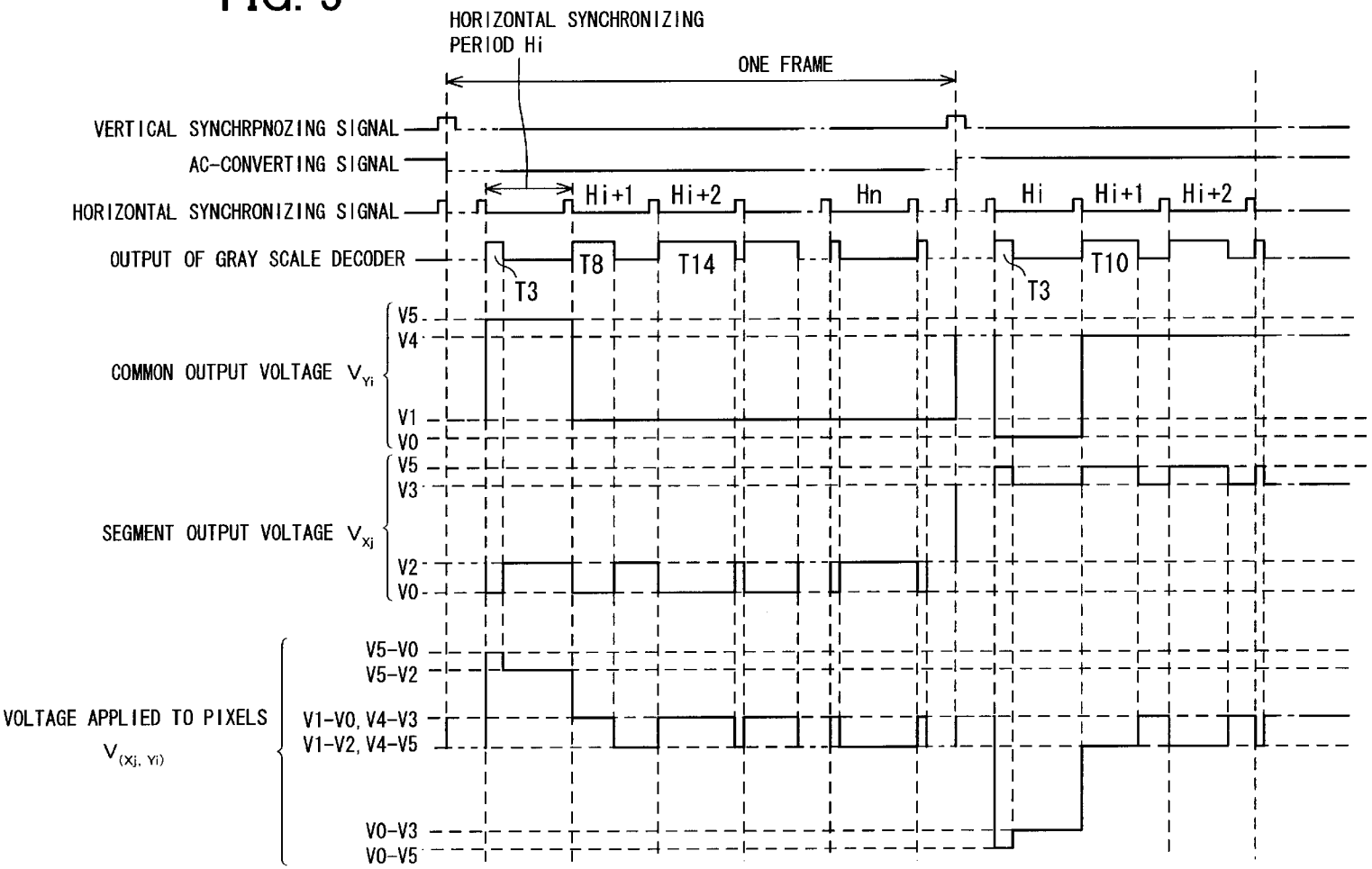
FIG. 5 is a timing chart, illustrating output waveforms of a common driver and a segment driver of the liquid crystal display apparatus shown in FIG. 4, a voltage waveform applied to pixels of a liquid crystal panel, etc.

Now, FIG. 5 is a timing chart, illustrating output waveforms of the common driver 2 and the segment driver 3 of the liquid crystal display apparatus as above, a voltage waveform applied to pixels of the liquid crystal panel 1, etc.

The gray scale display by means of the pulse-width modulation method is arranged such that m sets of the digital display data are transferred in the segment driver 3 in one horizontal synchronous period (a period between two horizontal synchronizing signals) Hi so as to be latched by the horizontal synchronizing signal, and during the next horizontal synchronous period Hi+1, the display data is fixed so as to be outputted. Then in the next horizontal synchronous period Hi+2, new display data is supplied so as to be latched. The latched display data is supplied to a gray scale decoder (not illustrated) in the segment driver 3, so that a gray scale display pulse width is selected in compliance with the display data, and then supplied to the segment electrodes X1–Xm of the liquid crystal panel 1 from the respective output terminals of the segment driver 3. As described above, the gray scale display by means of the pulse-width modulation method is arranged so that one frame of displaying is produced by successively supplying gray scale display pulses corresponding to the display data during the horizontal synchronous periods Hi through Hn.

Then the following drive voltage is supplied to a pixel (Xj, Yi) of the liquid crystal panel 1.

In a gray scale decoder in the segment driver 3, which corresponds to the pixel Xj, a gray scale display pulse having the width corresponding to the digital display data is selected from a plurality of gray scale pulses (for instance, T0 through T15 in the case of 16-level gray scale), so that the selected gray scale display pulse is outputted from the segment driver 3 (gray scale decoder output j). Then when the pulse width is equal to the width of the selected gray scale display pulse, the voltage of the driving electric power V0 (or the voltage of the driving electric power V5, in the case of another frame which is reversed due to the AC-converting signal) is supplied from the terminals of the segment driver 3 to the respective electrodes Xj of the liquid crystal panel 1. In contrast, when the pulse width is not equal to the width of the selected gray scale display pulse, the voltage of the driving electric power V2 (or the voltage of the driving electric power V3, in the case of another frame which is reversed due to the AC-converting signal) is supplied from the terminals of the segment driver 3 to the respective electrodes Xj of the liquid crystal panel 1.

On the other hand, from the common driver 2 to the common electrodes Yi, the voltage of the driving electric power V5 (or the voltage of the driving electric power V0 in the case of another frame which is reversed due to the AC-converting signal) is supplied when the scanning is carried out, whereas the voltage of the driving electric power V1 (or the voltage of the driving electric power V4 in the case of another frame which is reversed due to the AC-converting signal) is supplied when the scanning is not carried out.

As described above, since the applied voltages are added up so as to be applied to the pixel (Xj, Yi) of the liquid crystal panel 1, the effective voltage of the pixel is varied so that the gray scale display in accordance with the gray scale display pulse width is carried out.

Next, referring to FIGS. 1 through 3, the power supply circuit 5 is described as below. Here, as already described, the power supply circuit 5 supplies the voltages to the segment driver 3 and the common driver 2. By the way, a generation circuit for supplying voltages to the segment driver 3 is substantially identical with a generation circuit for supplying voltages to the common driver 2. Therefore the generation circuit for supplying a voltage for the segment driver 3 is taken as an example here, for the sake of simplicity.

Figure 1:
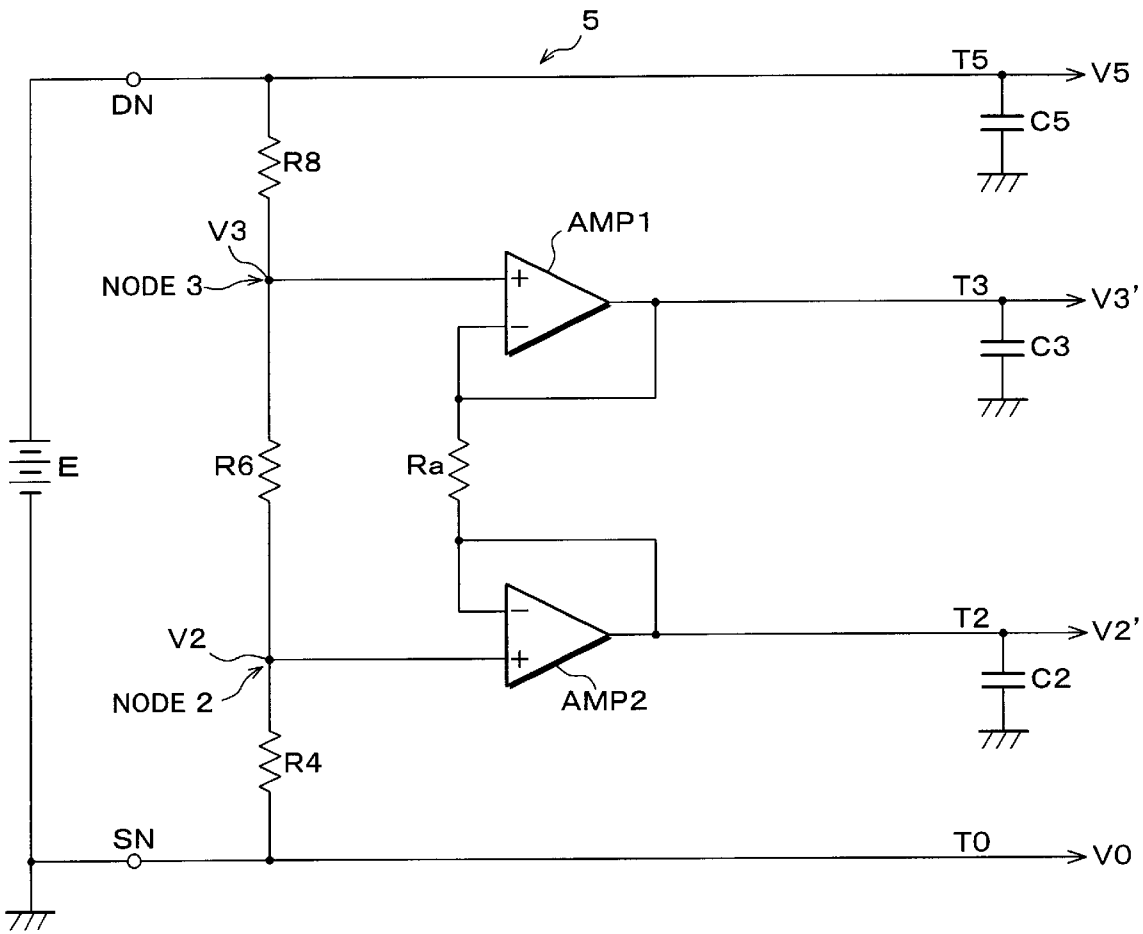
FIG. 1 is a circuit diagram, illustrating an arrangement of a power supply circuit in accordance with an embodiment of the present invention.

FIG. 1 is an explanatory view, indicating an example of the power supply circuit 5. Here, while the power supply circuit of the prior art is described as a circuit with negative voltages, the circuit of this example is described as a circuit with positive voltages.

As illustrated in FIG. 1, the power supply circuit 5 includes: bleeder resistances R4, R6, and R8 which constitute a resistance voltage-dividing circuit for setting internal voltages V2' and V3'; and differential amplifier circuits (operational amplifiers) AMP1 and AMP2 which have a voltage-follower arrangement and are provided for subjecting the outputs of the respective intermediate voltages V2' and V3' to low-impedance conversion.

In the power supply circuit 5, smoothing capacitors C2, C3, and C5 are also provided between output terminals T2, T3, and T5 and the grounding, respectively. Being different from the power supply circuit 37 (FIG. 9), the power supply circuit 5 does not include the resistances R101–R103 which are for converging the output voltages to the targeted voltage values. Therefore, after the values of the respective output voltages are brought into the acceptable ranges ΔV, the output voltages fluctuate within the ranges ΔV so as not to be converged to the targeted values of the respective driving electric powers V2 and V3, when only the differential amplifier circuits AMP1 and AMP2 are activated. For this reason, the power supply circuit 5 is provided with the smoothing capacitors C2, C3, and C5 corresponding to the respective output terminals T2, T3 and T5. Incidentally, the output terminal T0 is connected to the grounding, so as not to be provided with the smoothing capacitor.

Furthermore, the power supply circuit 5 is arranged so that a resistance (voltage-regulating means) Ra is inserted between the output terminals T2 and T3 which respectively output the output voltages V2' and V3' which are to be the drive voltages V2 and V3 applied to the liquid crystal panel 1. The value of the resistance Ra is described later.

Moreover, in the power supply circuit 5, in the regulated state (input voltage=output voltage), the differential amplifier circuits AMP1 and AMP2 are arranged so that the constant currents running through the respective output stages therein are minute, in order to reduce the power consumption. In contrast, in the transitory state (input voltage≠output voltage), the differential amplifier circuits AMP1 and AMP2 are arranged so that the input voltages are promptly modified to be the regulated state and large amount of currents can pass through.

Next, referring to FIGS. 2 and 3, an example of the arrangements of the differential amplifier circuits AMP1 and AMP2 is described as below.

Each of the differential amplifier circuits AMP1 and AMP2 includes a first differential stage and a second differential stage, and an output stage thereof is composed of: a first output stage which outputs a current to the outside, in accordance with the fluctuation of the current of the first differential stage; a second output stage which receives a current from the outside, in accordance with the fluctuation of the current of the second differential stage; and a third output stage which is a load circuit, and the differential amplifier circuit receives an input voltage from a positive input terminal (+) of the first and second differential stages and a voltage of the output stage is fed back to a negative input terminal (−) of the first and second differential stages. The offset voltage of the first differential stage is arranged to be different from the offset voltage of the second differential stage, in order to prevent the occurrence of a through current at the time of switching between a current output side and a current pull-in side in the output stage.

Figure 2:
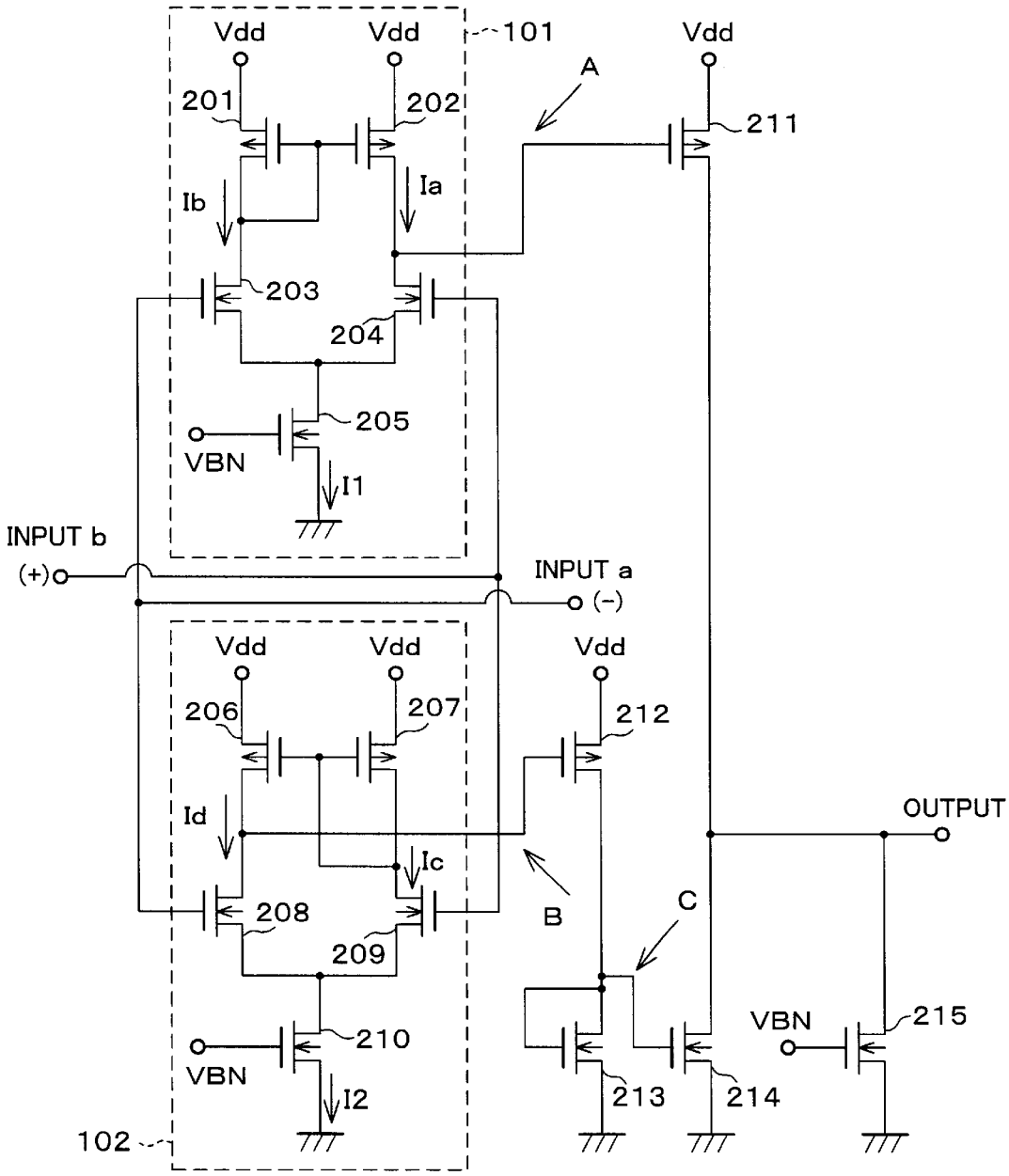
FIG. 2 is a circuit diagram, exemplifying an arrangement of a voltage follower circuit included in the power supply circuit shown in FIG. 1.

More specifically, as illustrated in FIG. 2, the differential amplifier circuits (voltage follower circuits) AMP1 and AMP2 are differential amplifier circuits having a voltage-follower arrangement. That is to say, each of the differential amplifier circuits AMP1 and AMP2 includes two differential stages 101 and 102, and each of the input sections of the respective differential stages is constituted by N-type transistors.

The first differential stage (current output side differential stage) 101 includes (i) a differential input circuit as the input section thereof, which is composed of: an N-type transistor 205 whose source is connected with the ground voltage GND and whose gate is connected with a constant voltage source VBN connected with a bias generation circuit (not illustrated); and N-type transistors 203 and 204 each having the source connected with the drain of the N-type transistor 205, and (ii) a current mirror circuit which is composed of P-type transistors 201 and 202 having: the drains connected with the drains of the N-type transistors 203 and 204 respectively; the gates connected with each other; and the sources both connected with the electric power (Vdd).

In this stage, the gate of the N-type transistor 203 constituting the differential input circuit is an input a, whereas the gate of the N-type transistor 204 is an input b. The gate of the current mirror circuit is connected with the drain of the N-type transistor 203 whose gate receives the input a.

In the meantime, the second differential stage (current pull-in side differential stage) 102 includes (i) a differential input circuit as the input section thereof, which is composed of: an N-type transistor 210 whose source is connected with the GND and whose gate is connected with the constant voltage source VBN connected with the bias generation circuit (not illustrated); and N-type transistors 208 and 209 each having the source connected with the drain of the N-type transistor 210, and (ii) a current mirror circuit which is composed of P-type transistors 206 and 207 having: the drains connected with the drains of the N-type transistors 208 and 209 respectively; the gates connected with each other; and the sources both connected with the electric power (Vdd).

In this stage, the gate of the N-type transistor 208 constituting the differential input circuit is an input a, whereas the gate of the N-type transistor 209 is an input b. The gate of the current mirror circuit is connected with the drain of the N-type transistor 209 whose gate receives the input b.

In the first differential stage 101, the drain of the N-type transistor 204 whose gate receives the input b is connected with the drain of the P-type transistor 202 and the gate of a P-type transistor (current output means) 211, the source of the P-type transistor 211 is connected with the electric power (Vdd), and the drain of the P-type transistor 211 is connected with the output of the whole circuit.

In the second differential stage 102, the drain of the N-type transistor 208 whose gate receives the input a is connected with the drain of the P-type transistor 206 and the gate of a P-type transistor 212, the source of the P-type transistor 212 is connected with the electric power (Vdd), and the drain of the P-type transistor 212 is connected with the gate and drain of an N-type transistor 213 and the gate of an N-type transistor (current pull-in means) 214. The sources of the respective N-type transistors 213 and 214 are connected with the GND, and the drain of the N-type transistor 214 is connected with the output of the whole circuit.

Moreover, the output is connected with the drain of an N-type transistor (constant current supplying means) 215 whose gate is connected with the constant voltage source VBN and source is grounded.

Furthermore, the input a is a negative input terminal and the input b is a positive input terminal.

Figure 3:
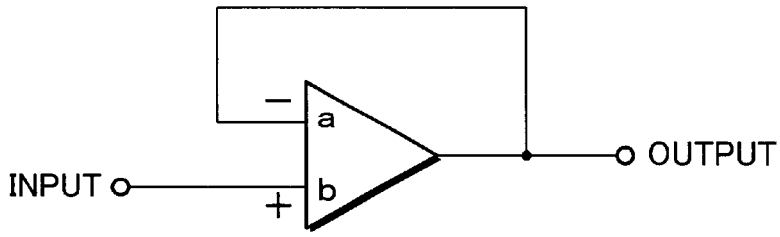
FIG. 3 is a circuit diagram, exemplifying an arrangement of a voltage follower circuit.

Now, FIG. 3 is a circuit diagram illustrating a voltage follower circuit in which the input b is adopted as the input of the circuit and the output of the differential amplifier circuit in FIG. 2 is fed back to the input a.

In this voltage follower circuit, the second difference stage 102 has an offset in order to prevent the through current which is generated when the input voltage is equal to the output voltage (regulated state), i.e. in order to prevent the current passing from the electric power to GND via the P-type transistor 211 and the N-type transistor 214. More specifically, for instance, the P-type transistor 206 is arranged so that the channel width thereof is narrowed or the channel length thereof is elongated, and the N-type transistor 209 is arranged so that the channel width thereof is widened or the channel length thereof is shortened.

On this account, the threshold voltage of the P-type transistor 206 is arranged to be higher than the threshold voltages of other P-type transistors, whereas the threshold voltage of the N-type transistor 209 is arranged to be lower than the threshold voltages of other N-type transistors.

The following description discusses the operation of the voltage follower circuit in the condition as above.

In this description, in the first differential stage 101, the constant current passing through the N-type transistor 205 whose gate is connected with the constant voltage source VBN is I1, the current passing through the P-type transistor 201 and the N-type transistor 203 is Ib, and the current passing through the P-type transistor 202 and the N-type transistor 204 is Ia.

Likewise, in the second differential stage 102, the constant current passing through the N-type transistor 210 whose gate is connected with the constant voltage source VBN is I2, the current passing through the P-type transistor 206 and the N-type transistor 208 is Id, and the current passing through the P-type transistor 207 and the N-type transistor 209 is Ic.

In the Case When Input Voltage>Output Voltage

In the first differential stage 101, Ia>Ib, the voltage at the point A decreases, and the P-type transistor 211 sets about being turned on, thus the current passing through the P-type transistor 211 increases, and the voltage of the output increases. As a result, the input voltage is shifted so as to be equal to the output voltage.

In contrast, in the second differential stage 102, IC>Id, the voltage at a point B increases, the P-type transistor 212 sets about being turned off, and the voltage at the point C decreases. On this account, the N-type transistor 214 sets about being turned off so as not to influence on the voltage of the output, and hence the voltage from the P-type transistor 211 is outputted without modification.

Here, there is also a current via the N-type transistor 215 which is the constant current source. However, the value of this current is small.

In the Case When Input Voltage<Output Voltage

In the first differential stage 101, Ia<Ib, the voltage at the point A increases, the P-type transistor 211 sets about being turned off, so as not to influence on the voltage of the output.

In contrast, in the second differential stage 102, Ic<Id, the voltage at the point B decreases, the P-type transistor 212 sets about being turned on, and the voltage at a point C decreases. Therefore, since the current passing through the N-type transistor 214 increases so that the current running towards GND increases, the voltage of the output decreases. On this account, the input voltage is shifted so as to be equal to the output voltage.

In the Case When Input Voltage=Output Voltage

The first differential stage 101 is in the regulated state, since Ia=Ib.

In contrast, since the second differential stage 102 is, as described above, arranged so that the threshold voltage of the P-type transistor 206 is specified to be higher than those of other P-type and N-type transistors and the threshold voltage of the N-type transistor 209 is specified to be lower than those of other P-type and N-type transistors, and hence the second differential stage has an offset voltage such as Ic>Id even if the input voltage is equal to the output voltage. Therefore, since the voltage at the point B is high, the P-type transistor 212 is being turned off, and thus, as described above, the N-type transistor 214 is still being turned off as well.

On this account, the output voltage is determined by the constant current passing through the P-type transistor 211 and the N-type transistor 215 which functions as the constant current source. Thus, it is possible to prevent the generation of through current passing through the P-type transistor 211 and the N-type transistor 214.

In this manner, in the above-mentioned voltage follower circuit, the increase of the output voltage is carried out by supplying a current from the power source voltage Vdd via the P-type transistor 211, whereas the decrease of the output voltage is carried out by causing a current flow into the ground voltage GND via the N-type transistor 214.

Thus, as already described above, when the driving ability of the P-type transistor 211 and the N-type transistor 214 are improved, the improvement of the ability to follow the voltage fluctuation is not hindered. As a result, although not illustrated in the figures, the voltage follower circuit can be properly driven even if a heavy load is connected with the output of the same.

Moreover, when the input voltage=output voltage, the current from the P-type transistor 211 is regulated so as to be always equal to a predetermined constant current, thanks to the N-type transistor 215. That is to say, in the case of the regulated state (input voltage=output voltage), the current above is regulated by the N-type transistor 215 which performs as the constant current source, and the driving ability of this N-type transistor 215 is nothing to do with the above-mentioned operation of following the voltage fluctuation. On this account, the operation of following can be properly carried out, even if the voltage of the constant voltage source VBN is decreased so that the current thereof is decreased.

Thus, since the value of the constant current is always kept small, providing the offset voltage between two differential stages, as in the voltage follower circuit of the present invention, makes it possible to realize the reduction of the power consumption concurrently with the ability of high-speed following, in the voltage follower circuit.

Now, generally characteristics of the transistor of the input section of each differential stage are inherently inconsistent, so that offset voltages exist in both positive and negative phases of one differential stage (this offset voltage is termed a differential stage internal offset voltage). However, the offset voltage in the present application is an offset voltage between two differential stages (inter-differential-stage offset voltage).

Also, in the present embodiment, Ia is equal to Ib only when the input voltage is equal to the output voltage, in the side of outputting the current (current output side). However, in the side of pulling the current in (current pull-in side), Ic is equal to Id only when the output voltage is higher than the input voltage by the value of the offset voltage. On this account, in response to the increase of the output voltage, a current pull-in section (N-type transistor 214) becomes a sufficient on-state, after a current output section (P-type transistor 211) has become a sufficient off-state and the offset voltage is generated. On this account, the power supply circuit 5 does not have a range of the output voltage, in which the current output section and the current pull-in section are simultaneously turned on.

In the description above, the differential amplifier circuit (FIG. 2) is arranged so that, (i) by narrowing the channel width or elongating the channel length, the threshold voltage of the P-type transistor 206 is specified to be higher than those of other transistors constituting the differential section and (ii) by widening the channel width or elongating the channel length, the threshold voltage of the N-type transistor 209 is specified to be lower than those of other transistors constituting the differential section, hereby the offset voltage is generated. On this account, the differential amplifier circuit is arranged so that, with respect to the output voltage, the current pull-in section (N-type transistor 214) becomes a sufficient on-state, after the current output section (P-type transistor 211) in the output stage has become a sufficient off-state and the offset voltage is generated.

So this differential amplifier circuit is adopted as the differential amplifier circuit AMP1 (FIG. 1), and hence the differential amplifier circuit AMP1 operates with a maximum voltage (−VL3 in FIG. 6) equivalent to the intermediate voltage V3 plus the offset voltage.

In contrast, (i) by widening the channel width or shortening the channel length, the threshold voltage of the P-type transistor 206 is specified to be lower than those of other transistors constituting the differential section and (ii) by narrowing the channel width or shortening the channel length, the threshold voltage of the N-type transistor 209 is specified to be higher than those of other transistors constituting the differential section, thereby the offset voltage in reverse to the offset voltage above may be generated. On this account, this differential amplifier circuit is arranged so that, with respect to the output voltage, the current output section (P-type transistor 211) becomes a sufficient on-state, after the current pull-in section (N-type transistor 214) in the output stage has become a sufficient off-state and the offset voltage is generated.

This differential amplifier circuit is adopted as the differential amplifier circuit AMP2 (FIG. 1), and thus the differential amplifier circuit AMP2 operates with a minimum voltage (−VH2 in FIG. 6) equivalent to the intermediate voltage V2 minus the offset voltage.

In the power supply circuit 5 (FIG. 1) arranged as above, when the voltage of the output terminal T2 varies from an original voltage value towards the ground voltage so as to be below a minimum value, a pMOS transistor 211 of the differential amplifier circuit AMP2 is turned on in order to charge or discharge the capacities of the pixels and electrodes, at the time of driving the pixels of the liquid crystal panel 1 (FIG. 4) by the voltage of the output terminal T2. When the pMOS transistor 211 is turned on, the electric power E (Vdd) supplies a current via the pMOS transistor 211 which has good driving ability, so that the voltage of the output terminal T2 rapidly gets back to an original voltage value.

In contrast, when the voltage of the output terminal T2 surpasses the intermediate voltage V2 which is set at a node 2, the differential amplifier circuit AMP2 turns the nMOS transistor 214 on. When the nMOS transistor 214 is turned on, a current is inputted via the nMOS transistor 214 which has good driving ability so that the voltage of the output terminal T2 rapidly gets back to an original value.

The operation of the differential amplifier circuit AMP1 in connection with the output terminal T3 is similar to the above. That is to say, when the voltage of the output terminal T3 varies from an original voltage value towards the ground voltage so as to be below the voltage value of the intermediate voltage V3 which is set at a node 3, the differential amplifier circuit AMP1 turns the pMOS transistor 211 on. When the pMOS transistor 211 is turned on, a current is supplied from the electric power E (Vdd) via the pMOS transistor 211 which has good driving ability, so that the voltage of the output terminal T3 rapidly gets back to an original voltage value.

In contrast, when the voltage of the output terminal T3 surpasses the maximum voltage value, the nMOS transistor 214 of the differential circuit AMP1 is turned on. When the nMOS transistor 214 is turned on, a current is inputted via the nMOS transistor 214 which has driving ability, so that the voltage of the output terminal T3 rapidly gets back to an original voltage value.

Here, if the resistance Ra is not provided between the output terminals T2 and T3, both the voltage of the output terminal T2 and the voltage of the output terminal T3 are not regulated within the respective acceptable ranges ΔV of the voltage fluctuation. In contrast, in the power supply circuit 5, the resistance Ra is inserted between the output terminals T2 and T3 so that a current is supplied from the output terminal T3 to the output terminal T2 via the resistance Ra. As a result, the voltage of the output terminal T2 increases so as to vary towards the voltage of the output terminal T3, whereas the voltage of the output terminal T3 decreases so as to vary towards the voltage of the output terminal T2.

Thus, in the power supply circuit 5 (FIG. 1), when the value of the resistance Ra is reduced, the output voltage V2' increases in the output terminal T2, and when this voltage V2' surpasses the value of the intermediate voltage V2 which is set at the node 2, the nMOS transistor 214 is turned on in order to bring the value of the output voltage V2' back to the value of the voltage V2 at the node 2, whereas in the output terminal T3, when the value of the resistance Ra is reduced, the output voltage V3' decreases so as to be below the intermediate voltage V3 set at the node 3. At this moment, the pMOS transistor 211 is turned on in order to bring the value of the output voltage V3' back to the value of the voltage V3 at the node 3.

As a result, the value of the resistance Ra is arranged so that the nMOS transistor 214 of the differential amplifier circuit AMP1 and the pMOS transistor 211 of the differential amplifier circuit AMP2 are turned on or are arranged to be in the state immediately before being turned on, and this enables to realize the following arrangements. That is, it is possible to constantly output the output voltage V2' at the value of the intermediate voltage V2 set at the node 2 (or the voltage value substantially equivalent to the intermediate voltage V2) without fluctuation (or with minute fluctuation), and also it is possible to constantly output the output voltage V3' at the value of the intermediate voltage V3 set at the node 3 (or the voltage value substantially equivalent to the intermediate voltage V3) without fluctuation (or with minute fluctuation).

On this account, even if a noise enters into the node 2, the node 3, the output terminal T2, or the output terminal T3, it is possible to output a constant (or substantially constant)

voltage without the above-mentioned fluctuation within the acceptable range ΔV.

On account of an operation similar to the above, when the output voltage V2' decreases so as to be below the minimum value of the voltage fluctuation, the pMOS transistor 211 of the differential amplifier circuit AMP2 is turned on. In contrast, when the output voltage V3' increases so as to surpass the maximum value of the voltage fluctuation, the nMOS transistor 214 of the differential amplifier circuit AMP1 is turned on.

Then, taking account of the charging or discharging of the capacitance of the pixels and electrodes provided in the liquid crystal panel 1, the effectiveness of the arrangement of power supply circuit 5 is further clarified.

That is, as illustrated in FIG. 5, the voltages applied to the electrodes of the liquid crystal panel 1 are arranged in such a manner that, when the capacitances of the pixels and electrodes of the liquid crystal panel 1 are charged or discharged, the output voltage V2' corresponding to the driving electric power V2 is increased on account of V5 whereas the output voltage V3' corresponding to the driving electric power V3 is decreased on account of V0, at the moments of large voltage differences such as (V5–V2) level and (V0–V3) level.

Taking account of the charging or discharging of capacitances of pixels and electrodes of the liquid crystal panel 1, the values of the intermediate voltages V2 and V3 are specified at target voltage values (applied voltage value) of the driving electric powers V2 and V3, respectively.

On this account, even if the output voltages V2' or V3' (susceptible to fluctuate) fluctuate by reason of the above-mentioned charging or discharging, the MOS transistors 214 in the differential amplifier circuit AMP1 or 211 in the differential amplifier circuit AMP2 is promptly turned on, so that the output voltage is swiftly brought back to a predetermined voltage value. Also, since the intermediate voltages (not susceptible to fluctuate) have the respective acceptable ranges ΔV, the fluctuations of the output voltages are properly controlled.

Thus, when the power supply circuit 5 arranged as above is adopted, the ratio between the resistances R4 through R8 are specified so that the driving electric powers V0, V2, V3, and V5, which are applied to the liquid crystal panel 1, take predetermined values respectively and the value of the resistance Ra is specified so that the nMOS transistor 214 of the differential amplifier circuit AMP1 and the pMOS transistor 211 of the differential amplifier circuit AMP2 are turned on or arranged to be in the state immediately before being turned on, and hence it is possible to provide a power supply circuit which is low-power-consumption type, in which voltages hardly fluctuate and are promptly brought back to predetermined values when fluctuate.

Incidentally, it is easy to adopt the power supply circuit 5 to the power supply circuit of V1 and V4.

Also, the resistance Ra may have a fixed value as described above, or may have a value adjusted by a laser trimming, etc. Moreover, the resistance Ra may be a variable resistance which is constituted by a plurality of resistances and whose value is properly adjusted on the basis of a control signal supplied from the outside by switching means.

Furthermore, although the method of changing the offset of the differential section of the input stage of each of the differential amplifier circuits AMP1 and AMP2 is described in the example above in which the shape of the P-type transistor 206 or N-type transistor 209 is changed, this changing of the offset may be realized by changing the shape of another transistor, or realized by changing the concentration of impurities in the channel section of the transistor or by changing the thickness of the gate so as to change the threshold voltage, instead of changing the shape of the transistor. However, the manufacturing condition is consistent in the case of changing the shape of the transistor, so that the manufacturing can be easily carried out.

As described above, the power supply circuit 5 is arranged so that the current output section (P-type transistor 211), which constitutes the output stage of the differential amplifier circuit AMP1 having a voltage-follower arrangement, is not turned on simultaneously with the current pull-in section (N-type transistor 214) which constitutes the output stage of the differential amplifier circuit AMP2 having a voltage-follower arrangement, so that it is possible to prevent the generation of the through current. Since this enables to reduce the power consumption, the power supply circuit 5 is suitable for a power supply circuit of a liquid crystal display apparatus adopted in a portable apparatus.

Moreover, the power supply circuit 5 is arranged so that a small amount of electricity is consumed in the regulated state, the transition from the transitory state to the regulated state is quickly carried out, and a large amount of current is allowed to pass through the circuit. On this account, it is possible to realize high-quality image displaying.

Furthermore, the offset voltages of the respective differential amplifier circuits AMP1 and AMP2 are arranged insofar as the current output section and the current pull-in section are not simultaneously turned on. On this account, it is possible to arrange the fluctuation acceptable range ΔV as narrow as possible. Thus, since the voltage fluctuation within the fluctuation acceptable range ΔV is arranged to be small, the capacity of a smoothing capacitor provided in the output terminal is reduced so that the power supply circuit can be downsized.

Thus, the power supply circuit 5 is suitably adopted as a power supply circuit of an apparatus which: has a capacitive load; has to be charged or discharged quickly; and has to be a low-power-consumption type, and the power supply circuit 5 is particularly suitable for a display apparatus for a mobile display apparatus.

Figure 9:
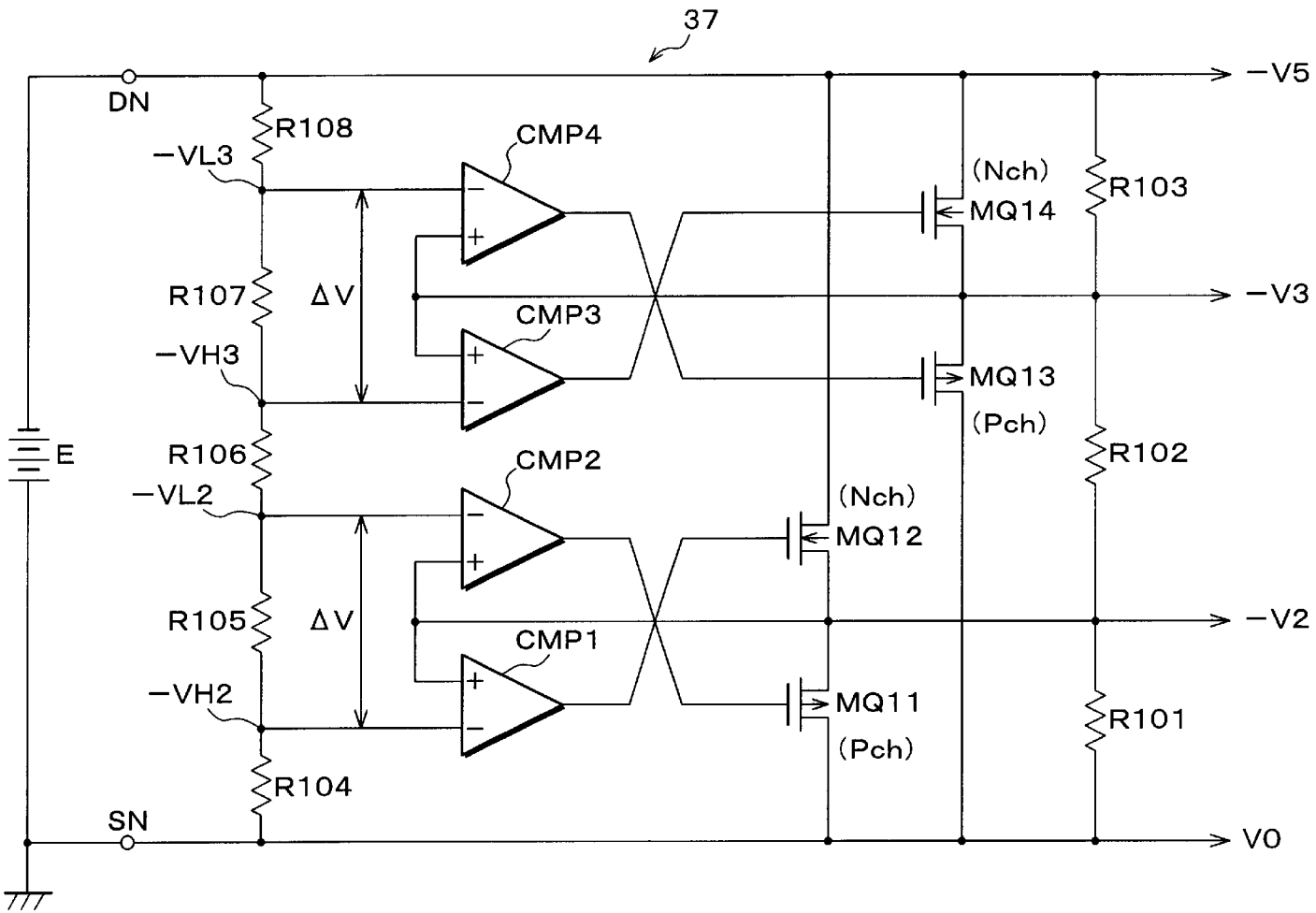
FIG. 9 is a circuit diagram, illustrating an arrangement of a conventional power supply circuit.

Lastly, referring to FIG. 6, a power supply circuit 5', from which the power supply circuit 5 was developed, is described below. this power supply circuit 5' is proposed by the applicant of the present invention, for solving the problems of the conventional power supply circuit 37 (FIG. 9).

Figure 6:
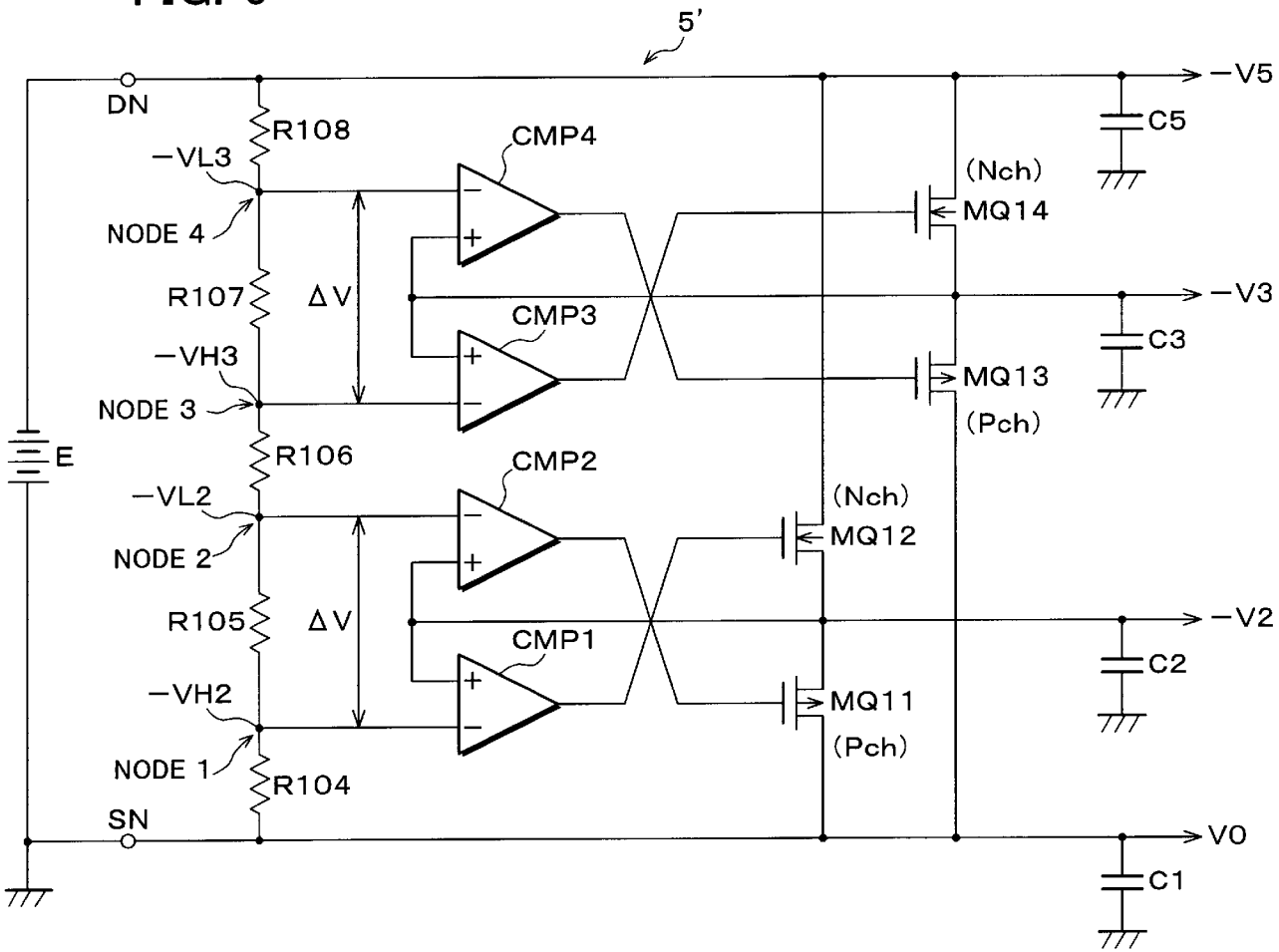
FIG. 6 is a circuit diagram, illustrating an arrangement of a power supply circuit from which the present invention is developed.
Figure 7:
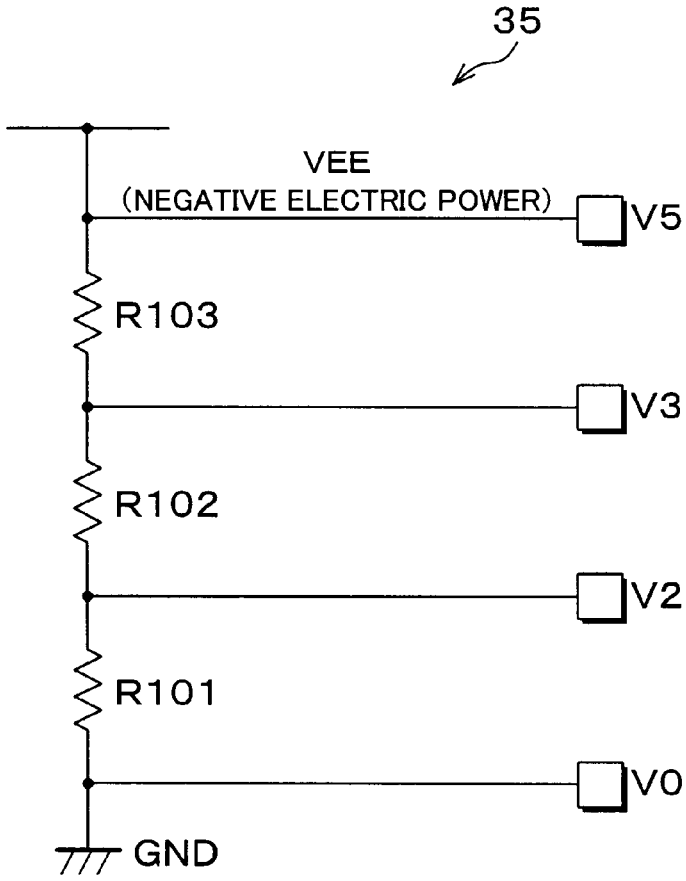
FIG. 7 is a circuit diagram, illustrating an arrangement of a conventional power supply circuit.
Figure 8:
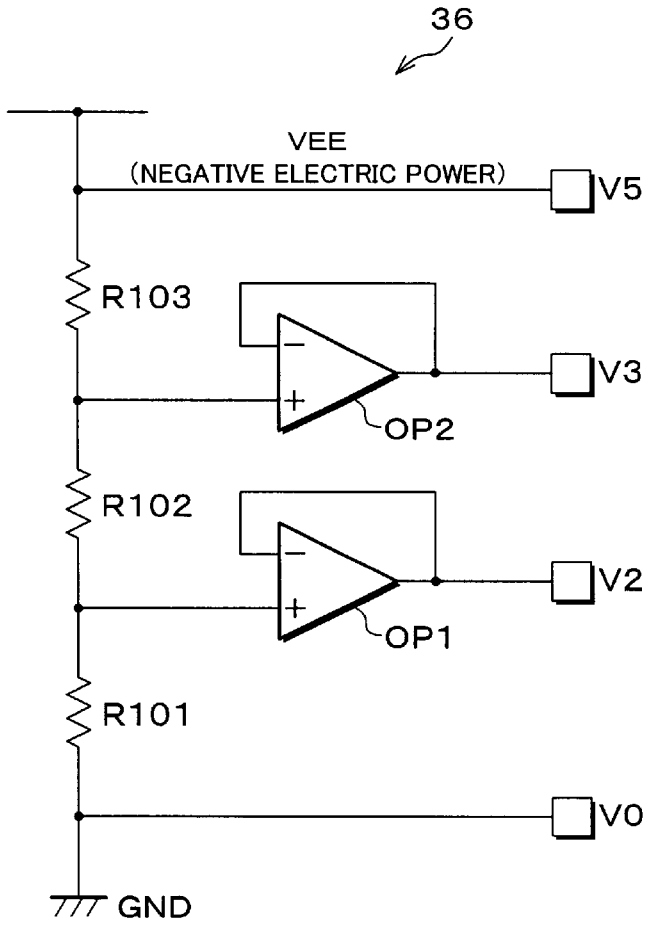
FIG. 8 is a circuit diagram, illustrating an arrangement of a conventional power supply circuit.

As illustrated in FIG. 6, the power supply circuit 5' is arranged such that the resistances R101–R103 are removed from the output stage of the power supply circuit 37 provided with two types of the resistance voltage-driving circuits which are constituted by the resistances R101–R103 and the resistances R104–R108 respectively.

On this account, the current passing through the resistances R101–R103 is omitted so that it is possible to carry out further reduction of the power consumption. Moreover, since the voltage-dividing ratio is not determined in the resistances R101–R103 in the output stage, the size of the circuit does not increase even if the programmable modification of the resistance values using an internal resistor is carried out.

However, in this power supply circuit 5', since the resistances R101–R103 which make the output voltages converge to the respective target voltage values are removed, after the output voltages falling within the acceptable ranges ΔV, only the comparators CMP1–CMP4 operate so that the output voltages fluctuate within the respective acceptable ranges ΔV, so as not to converge to the target voltage values which are equivalent to the respective driving electric powers −V2 and −V3. Thus, in the power supply circuit 5', the smoothing capacitors C1, C2, C3, and C5 are provided so that the output voltages converge to the respective target voltage values.

In the case of the power supply circuit 5', the voltage fluctuations beyond the acceptable ranges ΔV are amended by the same method as that of the power supply circuit 37. However, since the bleeder resistances R101–R103 which determine the output voltages in the output stage are removed, the values of the output voltages corresponding to the driving electric powers −V2 and −V3 respectively are not kept constant within the acceptable ranges ΔV, and hence the voltage fluctuations in the respective acceptable ranges ΔV are inevitable.

That is to say, the output voltage corresponding to the driving electric power −V2 is not regulated at the intermediate value between the reference voltage −VH2 and the reference voltage −VL2 (−VL2+(ΔV/2) when the characteristic of the comparator CMP1 is identical with that of the comparator CMP2), and when a noise enters into the node 1, node 2, or the output voltage, the comparators CMP1 and CMP2 respond to this noise so that the output voltage unsteadily fluctuates between the value of the reference voltage −VH2 and the reference voltage −VL2. Thus, the output voltage corresponding to the driving electric power −V2 fluctuates in the range −V2±(ΔV/2) rather than being regulated at a certain voltage value.

Incidentally, since reducing the values of the resistances R105 and R107 makes it possible to restrain the width of the acceptable range ΔV even if the output voltage fluctuates in the range −V2±(ΔV/2), the power supply circuit 5' can be adopted in a liquid crystal panel which allows voltage fluctuation to some extent. However, as described above, a power supply circuit is required to have a drive voltage with small fluctuation in order to realize high-quality displaying, and hence the power supply circuit 5' cannot comply with further improvement of the quality of liquid crystal display images.

Furthermore, to avoid the entrance of the noise, which causes the fluctuation of the output voltage, into the input stages of the respective comparators CMP1 and CMP2, the acceptable range ΔV has to be wide. However, when the acceptable range ΔV is wide, only the comparators CMP1 and CMP2 operate so that the output voltage fluctuates within the acceptable range ΔV. Therefore, if the acceptable range ΔV is too wide, the fluctuation cannot be compensated by the smoothing capacitors C2 and C3, and thus the power supply circuit 5' cannot comply with further enlargement of the screen size and further improvement of the quality, of the liquid crystal image display.

Although the output voltage corresponding to the driving electric power −V2 is described here, the same holds true for the output voltage corresponding to the driving electric power −V3, which is arranged identical with the output voltage corresponding to the driving electric power −V2.

As described above, in the power supply circuit 5', since the bleeder resistances R101–R103 in the output stage are not provided, the output voltages corresponding to the driving electric powers −V2 and −V3 respectively are unstable within the respective acceptable ranges ΔV, so that the voltage fluctuations within the respective acceptable ranges ΔV are inevitable.

The power supply circuit 5 was developed from this power supply circuit 5', so that the fluctuations of the output voltages within the respective acceptable ranges ΔV are considerably restrained and the voltage of the driving electric powers are steadily supplied. By the way, the applicant of the present invention has also proposed a method of solving the problem above, in Patent Application No. 2001-110600 "Power Supply and Display Apparatus Including the Same" (filing date: Apr. 9, 2001).

As described above, the power supply in accordance with the present invention is arranged so as to include: a resistance voltage-dividing circuit for generating an intermediate voltage, whose targeted voltage value is specified, from a supplied voltage; at least one voltage follower circuit including (i) current pull-in means for causing a current flow into the at least one voltage follower circuit from an outside when the intermediate voltage is higher than the targeted voltage value and (ii) current output means which outputs a current to the outside when the intermediate voltage is lower than the targeted voltage value, a fluctuation acceptance range of the intermediate voltage with respect to the targeted voltage value being specified so as to be equivalent to a difference between an operation-starting voltage of the current pull-in means and an operation-starting voltage of the current output means; and voltage regulating means for regulating the intermediate voltage at a value approximately equal to the targeted voltage value, by activating either one of the current output means or the current pull-in means so as to vary the intermediate voltage.

Moreover, the power supply in accordance with the present invention is arranged so that the at least one voltage follower circuit includes: a first differential stage; a second differential stage having an offset voltage, which determines the fluctuation acceptable range, with respect to the first differential stage; constant current supplying means which functions as a constant current source; an input terminal, which is connected with both of a positive input terminal of the first differential stage and a positive input terminal of the second differential stage, to which an input voltage is supplied; and an output terminal (I) connected with the current output means, the current pull-in means, and the constant current supplying means and (II) feeding an output voltage, which is supplied from the current output means, the current pull-in means, and the constant current supplying means, back to a negative input terminal of the first differential stage and a negative input terminal of the second differential stage, the current output means selecting either one of the first differential stage or the second differential stage as an output side differential stage so as to output a current to the outside in accordance with variation of an output current of this output side differential stage, and the current pull-in means selecting either one of the first differential stage or the second differential stage as a pull-in side differential stage so as to cause a current to flow into the at least one voltage follower circuit, in accordance with variation of an output current of this pull-in side differential stage.

According to the arrangements above, the voltage follower circuit operates to output a current to the outside by the output side differential stage and the current output means, when the output voltage is smaller than the input voltage so that the output voltage is required to be increased. In contrast, when the output voltage is larger than the input voltage so that the output voltage is required to be decreased, the voltage follower circuit operates to pull in a current from the outside by the pull-in side differential stage and the current pull-in means.

Thus, both when the output voltage is larger than the input voltage and when the output voltage is smaller than the input voltage, the regulated state in which the input voltage equals to the output voltage can be promptly realized without increasing the constant current supplied from the constant current source to the output terminals.

On this account, it is possible to quickly make the output voltage approximately equal to the input voltage without increasing the power consumption.

Moreover, in the voltage follower circuit, since the second differential stage has an offset voltage with respect to the first differential stage, the through current which penetrates through the circuit in the constant current supplying means is not generated even after the transition to the regulated state.

That is to say, in response to the increase of the output voltage, the current pull-in means becomes a sufficient on-state, after the current output means has become a sufficient off-state and the offset voltage is generated. On this account, there are no ranges of the output voltage in which the current output section and the current pull-in section are simultaneously turned on. By the way, the sufficient on-state varies depending on the degree of the prevention of the through current, and thus, when it is required to completely avoid the generation of the through current, the offset voltage is arranged so that one means starts to be turned on after the other means has completely been turned off.

Furthermore, the power supply in accordance with the present invention is arranged such that the first differential stage and the second differential stage are identically constructed except that, in a channel length and/or a channel width, at least one of transistors constituting the first and second differential stages is different from the remaining transistors.

On this account, it is possible to provide an offset voltage between the first and second differential stages by a simpler arrangement, and hence, with a simper arrangement, it is possible to prevent the generation of the through current penetrating through the circuit in the constant current source supplying means.

Moreover, the power supply in accordance with the present invention is arranged such that in the at least one voltage follower circuit in a regulated state, only either one of the current output means and the current pull-in means operates on condition that the constant current supplying means is connected as a load.

In the above-mentioned arrangement, furthermore, at the time of the regulated state in which the input voltage is equal to the output voltage, only either one of the current output means and the current pull-in means operates on condition that the constant current supplying means is connected as a load.

Thus, it is possible to simplify the flow of a current in the regulated state so that the design and arrangement of the circuit can be further simplified.

Moreover, the power supply in accordance with the present invention is arranged such that the voltage regulating means is constructed by connecting an output of the at least one voltage follower circuit with a voltage not equal to the output of the at least one voltage follower circuit via a resistance.

According to this arrangement, it is possible to easily realize the voltage regulating means having the above-identified function.

Furthermore, the power supply in accordance with the present invention is arranged such that the resistance voltage-dividing circuit generates at least two intermediate voltages, and the voltage regulating means is constructed by connecting outputs of two voltage follower circuits, to which two intermediate voltages are supplied respectively, with each other via a resistance.

According to this arrangement, it is possible to regulate two output voltages of the respective voltage follower circuits by connecting these two output voltages via the resistance. In this arrangement, it is neither necessary to provide other voltages nor to add a resistance to the resistance voltage-dividing circuit in order to output a reference voltage for determining the maximum and minimum voltage values. In other words, it is possible to easily realize the voltage regulating means with the above-identified function.

Moreover, the power supply in accordance with the present invention is arranged such that the voltage regulating means has a resistance which can be varied with a control signal supplied from an outside.

According to this arrangement, it is possible to vary the degree of making the output voltage approximately equal to the targeted voltage value, by changing the value of the resistance which is the voltage regulating means. That is to say, when the value of the resistance is reduced, the degree of making the output voltage approximately equal to the targeted voltage value becomes small so that the fluctuation of the output voltage becomes small and the response is quickened. In contrast, when the value of the resistance is increased, the degree of making the output voltage approximately equal to the targeted voltage value becomes large so that the fluctuation of the output voltage becomes large and the response is slowed down.

Here, when the current output means and the current pull-in means are activated in order to make the output voltage approximately equal to the targeted voltage value so as to regulate the output voltage, the value of the resistance is preferably arranged to let the current output means and the current pull-in means be turned on or become the state immediately before being turned on.

Then taking account of the characteristics and use conditions of the display panel connected to the power supply, it is possible to determine the value of the resistance constituting the voltage regulating means, after the power supply is manufactured. On this account, in compliance with conditions such that good/bad response characteristics of the display panel, requirement of high-quality display, noticeable irregularity of images on a large screen, etc., it is possible to arrange the degree of making the output voltage approximately equal to the targeted voltage value, in light of the power consumption, so that the versatility of the power supply is improved.

The power supply which is arranged as above is particularly suitable for a power supply that supplies driving electric powers to the display panel. Possible candidates of the display apparatuses on which this power supply is mounted are such as a liquid crystal display apparatus with a liquid crystal panel, an EL display apparatus with an electroluminescence panel (ELP), a PD display apparatus with a plasma display panel (PDP), a display apparatus with a plasma addressed liquid crystal (PALC) panel in which a liquid crystal panel is incorporated with a plasma display panel, etc. Moreover, thanks to the low power consumption, the above-identified power supply is particularly suitable for a display apparatus for a mobile apparatus such as portable terminals.

Furthermore, the above-mentioned voltage follower circuit may be arranged such that the first differential stage and the second differential stage are identically constructed except that at least one of transistors constituting the first and second differential stages has a channel section in which concentration of impurities is different from concentrations of impurities in respective channel sections of the remaining transistors.

Moreover, the above-mentioned voltage follower circuit may be arranged such that the first differential stage and the second differential stage are identically constructed except that at least one of transistors constituting the first and second differential stages has a gate film whose thickness is different from a thickness of gate films of the remaining transistors.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A power supply, comprising:

a resistance voltage-dividing circuit for generating an intermediate voltage, whose targeted voltage value is specified, from a supplied voltage;

at least one voltage follower circuit including (i) current pull-in means for causing a current flow into the at least one voltage follower circuit from an outside when the intermediate voltage is higher than the targeted voltage value and (ii) current output means for outputting a current to the outside when the intermediate voltage is lower than the targeted voltage value, a fluctuation acceptance range of the intermediate voltage with respect to the targeted voltage value being specified so as to be equivalent to a difference between an operation-starting voltage of the current pull-in means and an operation-starting voltage of the current output means; and voltage regulating means for regulating the intermediate voltage at a value approximately equal to the targeted voltage value, by activating either one of the current output means or the current pull-in means so as to vary the intermediate voltage.

2. The power supply as defined in claim 1, wherein the at least one voltage follower circuit includes:

a first differential stage;

a second differential stage having an offset voltage, which determines the fluctuation acceptable range, with respect to the first differential stage;

constant current supplying means which functions as a constant current source;

an input terminal, which is connected with both of a positive input terminal of the first differential stage and a positive input terminal of the second differential stage, to which an input voltage is supplied; and an output terminal (I) connected with the current output means, the current pull-in means, and the constant current supplying means and (II) feeding an output voltage, which is supplied from the current output means, the current pull-in means, and the constant current supplying means, back to a negative input terminal of the first differential stage and a negative input terminal of the second differential stage, the current output means selecting either one of the first differential stage or the second differential stage as an output side differential stage so as to output a current to the outside in accordance with variation of an output current of this output side differential stage, and the current pull-in means selecting either one of the first differential stage or the second differential stage as a pull-in side differential stage so as to cause a current flow into the at least one voltage follower circuit, in accordance with variation of an output current of this pull-in side differential stage.

3. The power supply as defined in claim 1, wherein, in the at least one voltage follower circuit, the first differential stage and the second differential stage are identically constructed except that, in a channel length and/or a channel width, at least one of transistors constituting the first and second differential stages is different from the remaining transistors.

4. The power supply as defined in claim 2, wherein, in the at least one voltage follower circuit, the first differential stage and the second differential stage are identically constructed except that, in a channel length and/or a channel width, at least one of transistors constituting the first and second differential stages is different from the remaining transistors.

5. The power supply as defined in claim 1, wherein, in the at least one voltage follower circuit, the first differential stage and the second differential stage are identically constructed except that at least one of transistors constituting the first and second differential stages has a channel section in which concentration of impurities is different from concentrations of impurities in channel sections of the remaining transistors.

6. The power supply as defined in claim 2, wherein, in the at least one voltage follower circuit, the first differential stage and the second differential stage are identically constructed except that at least one of transistors constituting the first and second differential stages has a channel section in which concentration of impurities is different from concentrations of impurities in channel sections of the remaining transistors.

7. The power supply as defined in claim 1, wherein, in the at least one voltage follower circuit, the first differential stage and the second differential stage are identically constructed except that at least one of transistors constituting the first and second differential stages has a gate film whose thickness is different from a thickness of gate films of the remaining transistors.

8. The power supply as defined in claim 2, wherein, in the at least one voltage follower circuit, the first differential stage and the second differential stage are identically constructed except that at least one of transistors constituting the first and second differential stages has a gate film whose thickness is different from a thickness of gate films of the remaining transistors.

9. The power supply as defined in claim 1, wherein, in the at least one voltage follower circuit in a regulated state, only either one of the current output means and the current pull-in means operates on condition that the constant current supplying means is connected as a load.

10. The power supply as defined in claim 2, wherein, in the at least one voltage follower circuit in a regulated state, only either one of the current output means and the current pull-in means operates on condition that the constant current supplying means is connected as a load.

11. The power supply as defined in claim 3, wherein, in the at least one voltage follower circuit in a regulated state, only either one of the current output means and the current pull-in means operates on condition that the constant current supplying means is connected as a load.

12. The power supply as defined in claim 4, wherein, in the at least one voltage follower circuit in a regulated state, only either one of the current output means and the current pull-in means operates on condition that the constant current supplying means is connected as a load.

13. The power supply as defined in claim 1, wherein the voltage regulating means is constructed by connecting an output of the at least one voltage follower circuit with a voltage not equal to the output of the at least one voltage follower circuit via a resistance.

14. The power supply as defined in claim 2, wherein the voltage regulating means is constructed by connecting an output of the at least one voltage follower circuit with a voltage not equal to the output of the at least one voltage follower circuit via a resistance.

15. The power supply as defined in claim 3, wherein the voltage regulating means is constructed by connecting an output of the at least one voltage follower circuit with a voltage not equal to the output of the at least one voltage follower circuit via a resistance.

16. The power supply as defined in claim 4, wherein the voltage regulating means is constructed by connecting an output of the at least one voltage follower circuit with a voltage not equal to the output of the at least one voltage follower circuit via a resistance.

17. The power supply as defined in claim 1, wherein the resistance voltage-dividing circuit generates at least two intermediate voltages, and the voltage regulating means is constructed by connecting outputs of two voltage follower circuits, to which two intermediate voltages are supplied respectively, with each other via a resistance.

18. The power supply as defined in claim 2, wherein the resistance voltage-dividing circuit generates at least two intermediate voltages, and the voltage regulating means is constructed by connecting outputs of two voltage follower circuits, to which two intermediate voltages are supplied respectively, with each other via a resistance.

19. The power supply as defined in claim 3, wherein the resistance voltage-dividing circuit generates at least two intermediate voltages, and the voltage regulating means is constructed by connecting outputs of two voltage follower circuits, to which two intermediate voltages are supplied respectively, with each other via a resistance.

20. The power supply as defined in claim 4, wherein the resistance voltage-dividing circuit generates at least two intermediate voltages, and the voltage regulating means is constructed by connecting outputs of two voltage follower circuits, to which two intermediate voltages are supplied respectively, with each other via a resistance.

21. The power supply as defined in claim 13, wherein the voltage regulating means has a resistance which can be varied with a control signal supplied from an outside.

22. The power supply as defined in claim 14, wherein the voltage regulating means has a resistance which can be varied with a control signal supplied from an outside.

23. The power supply as defined in claim 17, wherein the voltage regulating means has a resistance which can be varied with a control signal supplied from an outside.

24. The power supply as defined in claim 18, wherein the voltage regulating means has a resistance which can be varied with a control signal supplied from an outside.

25. A display apparatus, comprising a display panel, a drive unit for driving the display panel, and a power supply for supplying driving electric power, which is for driving the display panel, to the drive unit, wherein, the power supply includes:

a resistance voltage-dividing circuit for generating an intermediate voltage, whose targeted voltage value is specified, from a supplied voltage;

at least one voltage follower circuit including (i) current pull-in means for causing a current flow into the at least one voltage follower circuit from an outside when the intermediate voltage is higher than the targeted voltage value and (ii) current output means which outputs a current to the outside when the intermediate voltage is lower than the targeted voltage value, a fluctuation acceptance range of the value of the intermediate voltage with respect to the targeted voltage value being specified so as to be equivalent to a difference between an operation-starting voltage of the current pull-in means and an operation-starting voltage of the current output means; and voltage regulating means for regulating the intermediate voltage at a value approximately equal to the targeted voltage value, by activating either one of the current output means or the current pull-in means so as to vary the intermediate voltage.

26. The display apparatus as defined in claim 25, wherein, the at least one voltage follower circuit includes:

a first differential stage;

a second differential stage having an offset voltage, which determines the fluctuation acceptable range, with respect to the first differential stage;

constant current supplying means which functions as a constant current source;

an input terminal, which is connected with both of a positive input terminal of the first differential stage and a positive input terminal of the second differential stage, to which an input voltage is supplied; and an output terminal (I) connected with the current output means, the current pull-in means, and the constant current supplying means and (II) feeding an output voltage, which is supplied from the current output means, the current pull-in means, and the constant current supplying means, back to a negative input terminal of the first differential stage and a negative input terminal of the second differential stage, the current output means selecting either one of the first differential stage or the second differential stage as an output side differential stage so as to output a current to the outside in accordance with variation of an output current of this output side differential stage, and the current pull-in means selecting either one of the first differential stage or the second differential stage as a pull-in side differential stage so as to cause a current to flow into the at least one voltage follower circuit, in accordance with variation of an output current of this pull-in side differential stage.

27. The display apparatus as defined in claim 25, wherein, in the at least one voltage follower circuit, the first differential stage and the second differential stage are identically constructed except that, in a channel length and/or a channel width, at least one of transistors constituting the first and second differential stages is different from the remaining transistors.

28. The display apparatus as defined in claim 26, wherein, in the at least one voltage follower circuit, the first differential stage and the second differential stage are identically constructed except that, in a channel length and/or a channel width, at least one of transistors constituting the first and second differential stages is different from the remaining transistors.

* * * * *